US009647376B2

(12) United States Patent
Samojeden et al.

(10) Patent No.: US 9,647,376 B2
(45) Date of Patent: May 9, 2017

(54) TAMPER RESISTANT RECEPTACLE

(71) Applicant: Hubbell Incorporated, Shelton, CT (US)

(72) Inventors: Matthew J. Samojeden, Maryland Heights, MO (US); Scott B. Wurms, Shelton, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/743,532

(22) Filed: Jun. 18, 2015

(65) Prior Publication Data

US 2015/0372412 A1 Dec. 24, 2015

Related U.S. Application Data

(60) Provisional application No. 62/015,101, filed on Jun. 20, 2014.

(51) Int. Cl.
*H01R 13/453* (2006.01)

(52) U.S. Cl.
CPC ..... *H01R 13/4536* (2013.01)

(58) Field of Classification Search
CPC ..... H01R 13/447; H01R 13/5213
See application file for complete search history.

(56) References Cited

U.S. PATENT DOCUMENTS 3,980,372 A * 9/1976 Ranzanigo ..... H01R 13/4532 439/139
4,722,693 A * 2/1988 Rose ..... H01R 13/4534 439/137
4,970,349 A * 11/1990 Jones ..... H02G 3/14 174/67
5,096,432 A * 3/1992 Cullen ..... H01R 13/4532 439/137
5,466,164 A * 11/1995 Miyazaki ..... H01R 13/5213 439/140
5,490,790 A * 2/1996 Okada ..... H01R 13/4538 439/141
6,176,712 B1 * 1/2001 Huang ..... H01R 13/4538 439/140
6,224,401 B1 * 5/2001 Yu ..... H01R 13/4532 439/139
7,556,513 B2 * 7/2009 Ng ..... H01R 13/4534 439/137

(Continued)

*Primary Examiner* — Truc Nuyen
(74) *Attorney, Agent, or Firm* — Michael Best & Friedrich, LLP

(57) ABSTRACT

A tamper resistant receptacle having shutter doors engaging a toggle mechanism wherein each shutter door must engage the toggle mechanism to move the device into the open position. When engaged properly by insertion of force into both the hot and neutral openings of the device simultaneous by the hot and neutral blades of an electrical plug, the shutter doors pivot to contact the toggle platform with force sufficient to overcome a spring bias and allow the platform to descend downwardly a distance sufficient to uncover blade openings in the platform and allow the blades to engage the device's electrical contacts. If only one of the pivoting doors contacts the platform, the platform tips, or toggles, in the direction of the door which blocks the item inserted into the receptacle opening of the device from reaching the underlying electrical contact.

7 Claims, 7 Drawing Sheets

(56) References Cited

U.S. PATENT DOCUMENTS

| | | | | |
|---|---|---|---|---|
| 7,821,370 | B1 * | 10/2010 | Shu | G02B 6/4292 336/107 |
| 7,841,877 | B1 * | 11/2010 | Lai | H01R 13/4532 439/145 |
| 8,187,011 | B1 * | 5/2012 | Baldwin | H01R 13/4534 439/137 |
| 2007/0190813 | A1 * | 8/2007 | Okada | H01R 13/4532 439/34 |
| 2011/0165787 | A1 * | 7/2011 | Pfeiffer | H01R 13/625 439/310 |
| 2015/0180154 | A1 * | 6/2015 | Scanzillo | H01R 13/453 220/241 |

* cited by examiner

TAMPER RESISTANT RECEPTACLE

CROSS REFERENCE TO RELATED APPLICATION

The present application claims priority under to 35 U.S.C. 119(e) to U.S. Provisional Application 62/015,101, filed Jun. 20, 2014, the contents of which are hereby incorporated by reference in their entirety.

FIELD OF THE INVENTION

The present invention relates to tamper resistant electrical receptacles. More particularly, the present invention relates to tamper resistant electrical receptacles using shutters spring biased to block access to the device's electrical contacts absent simultaneous insertion of the blades of an electrical plug.

BACKGROUND OF THE INVENTION

Tamper resistant receptacles are known in the art. "Tamper Resistant" or "TR" receptacles are a class of electrical receptacle outlets configured to deny access to the device's electrical contacts unless force is applied simultaneously to both the hot and neutral plug openings of the device pursuant to NEC Code 406.11 et seq. The Code and related regulatory requirements provide that not only must the outlet openings remain blocked unless force is applied to both openings at the same time, but also that any foreign object 1/32 inch or larger, must be prevented from bypassing the blocking member of a plug opening.

As will be appreciated, these requirements were enacted in response to the phenomena of small children curiously inserting a small toy or metal object into the hot or neutral opening of a receptacle and suffering electrical shock, burns, or even death.

In meeting the standard and providing the level of protection sought from these devices, the art has gravitated towards a configuration of receptacles utilizing cooperating shutter members to block access beyond the faceplate openings of the outlet. Specifically, to ensure that force directed into only one of the two blade openings is prevented from reaching the electrical contact that lies beneath, a sliding shutter mechanism is spring-biased into a position blocking (or "shuttering") the blade opening from underneath the faceplate. The shutter physically prevents an object entering the blade opening from reaching the electrical contact below that shutter. In order to allow the shutter of a respective blade opening to be uncovered, the spring-bias must be overcome by a camming action caused by the other plug blade during insertion in the other blade opening.

To this end, the most common prior art configuration of a TR receptacle includes a shutter assembly comprising a pair of cooperating shutters. Each of the shutters includes a blocking portion positioned below a respective one of the blade openings blocking access to the contacts. Each of the shutters also includes a cam portion that extends to the opposite blade opening that receives contact from a plug blade and translates the vertical force of a plug blade and camming action into a lateral sliding displacement of the blocking portion. Thus, force by vertical insertion of a plug-blade on the neutral blade opening will move the shutter from obstructing access to the electrical contact below the hot blade opening, and vice versa. Specifically, for example, during insertion of a plug, the neutral blade tine will cam against and past the shutter cam surface forcing the shutter cam arm to move laterally, thereby overcoming the spring bias of the shutter and causing the hot blade shutter blocking portion to slide into a position away from and revealing the electrical contact beneath the hot blade opening. Likewise, force on the hot blade opening will contact the cam surface and allow the blade to cam past and move the arm and compress the spring to move the shutter blocking portion that covers the neutral blade opening out of the way. As will be appreciated, with this configuration, when a child tries to insert a toy into either opening of the outlet, the blocking portion of the shutter remains immobile from the spring bias of the opposite shutter and prevents the child from reaching the electrical contact. However, when both blades of an electrical plug contact the shutters simultaneously, the simultaneous force and camming action allows both blades to continue their downward insertion by simultaneously sliding respective shutter blocking portions laterally out of the way of the electrical contacts of the opposite shutter until the blades cam past the shutters and are able to properly "plug in" to the outlet's internal face contacts.

Existing prior art TR receptacle designs and their operational details are available in U.S. Pat. No. 4,379,607 to Bowden, Jr.; U.S. Pat. No. 7,645,148 to Carbone et al.; and U.S. Publ. No. 2013/0295788 to Baldwin, et al. and the references cited therein, the entire contents of which are hereby incorporated by reference in their entirety.

The proliferation of these important safety devices has led to an appreciation of the issues affecting their effective life span. A presently appreciated issue recognized by the present inventors stems from the translation of the vertical force of the plug blade into lateral movement of the shutters. The issue here is two-fold. First, the shutter bodies have to slide over each other to move into the open position. A majority of the force required to effectuate such movement stems from the frictional forces at play of the various surfaces rubbing against one another as they attempt to move. Secondly, in most prior art shutter assemblies, there is no way to use the combined force of the insertion plug blades to overcome a spring bias. Rather, each plug blade opening and shutter operates against its own spring bias independently. Over time, the point of contact for the plug blades on each shutter may deform to the point that so much additional force is needed to slide the shutter open that the device is no longer deemed operable. Another presently appreciated issue recognized by the present inventors stems from the sharpness of plug blades being found on electrical products imported from overseas. As will be appreciated, during insertion of the plug blades into the outlet face openings, the vertical force of the incoming blades has the same point of contact on the cam surface. The cam surface of most prior art devices is an inclined "ramp" of about 45° that is of a length sufficient to cause lateral displacement during insertion of a distance that is equal to the entire distance necessary to un-shutter a blade opening (typically about 1.8 mm). Over time, these sharp blades having a single point of initial contact begin to deform and cut into the ramp surface which makes movement more difficult as the blades get stuck in divets or scratches at the point of contact. With each successive insertion, more and more force is needed to friction force the camming action and concomitant lateral sliding of the shutters. At some point, the deformity of the ramp surface may make insertion of a plug excessively difficult or even impossible. As this point, the device has reached the end of its useful life.

The foregoing underscores some of the problems associated with conventional TR receptacles. Furthermore, the foregoing highlights the long-felt, yet unresolved need in the art for a TR receptacle that may extend the useful life of the device. Moreover, the forgoing highlights the long-felt, yet unresolved need in the art for a TR receptacle that has an extended service life at a reasonable cost.

SUMMARY OF THE INVENTION

Various embodiments of the present invention overcome various of the aforementioned and other disadvantages associated with prior art TR receptacles and offers new advantages as well. Although not wishing to be bound by theory, the present inventors recognize that reducing the frictional force and insertion force required to move the tamper resistant mechanism into the open position may extend the service life of some prior art TR receptacles.

According to one aspect of various embodiments of the present invention there is provided a TR receptacle having shutter doors engaging a toggle mechanism wherein each shutter door must engage the toggle mechanism to move the device into the open position.

According to another aspect of various embodiments of the present invention, there is provided a TR receptacle having a toggle mechanism wherein each shutter door pivots to influence the orientation of a toggle platform. When engaged properly by insertion of force into both the hot and neutral openings of the device, the shutter doors pivot to contact the toggle platform with force sufficient to overcome a spring bias and allow the platform to descend downwardly. The descent of the platform allows the doors to continue their downward pivoting path a distance sufficient to sweep along the surface of the platform a distance sufficient to uncover blade openings in the platform. The blade openings receive the plug blades therethrough and thus allow the blades to engage the device's electrical contacts.

According to a related aspect of various embodiments of the present invention, the TR receptacle is provided with a toggle mechanism wherein the insertion of force on only one of the device's plug-blades openings causes the platform to tip towards that side. The tipping of the platform prevents or blocks the platform from descending far enough for the doors to pivot into a position that exposes the plug blade openings in the platform, thereby blocking access to the devices electrical contacts.

In a presently preferred embodiment, the toggle platform includes a neck or plunger portion that is spring biased in the closed position. As the shutter doors contact the platform and overcome the spring bias, the neck portion is positioned to descend into an neck-receiving shaft of a plunger housing. The neck and platform descend until the blades of the plug pass through the platforms openings. According to this embodiment, a helical spring is deployed around the neck plunger and biased against a top step area of the plunger receptacle housing and the bottom of the platform. If only one of the pivoting doors contacts the platform, the platform tips, or toggles, in the direction of the door such that the bottom of the platform neck catches on a step on the plunger housing, thereby offsetting the path of the plunger sufficient enough to block its descent into the shaft of the plunger housing. Accordingly, the item inserted into the receptacle opening of the device is blocked from reaching the underlying electrical contact.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

Various aspects and advantageous features of the present invention will become more apparent to those of ordinary skill when described in the detailed description of preferred embodiments and reference to the accompany drawing wherein.

DETAILED DESCRIPTION OF A PREFERRED EMBODIMENT

Figure 1:
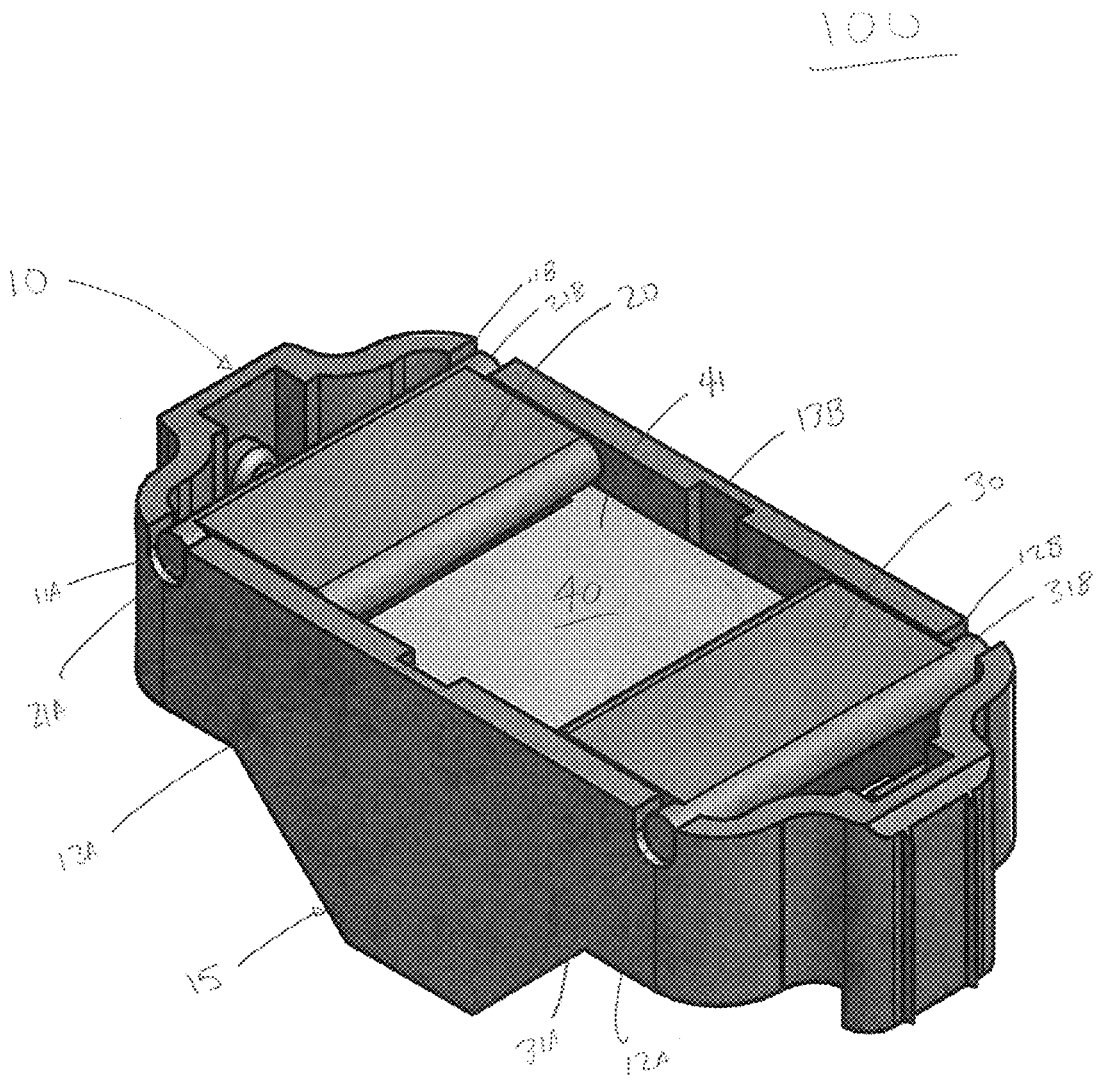
FIG. 1 is a top perspective view of a toggle TR assembly according to an exemplary embodiment of the invention.

While the present invention will be described in connection with a TR receptacle of the type having blocking shutters generally described above, it will be readily apparent to one of ordinary skill in the art armed with the present specification that the present invention can be applied to a multiplicity of fields and uses. In particular, the present invention may find use in connection with other types of TR receptacles where reduction in friction is desirable. Finally, one of ordinary skill in the art armed with the present specification will also understand that the present system may be easily modified to include different configurations, mechanisms, methods, and kits, which achieve some or all of the purposes of the present invention.

Turning to the Figures, a presently preferred embodiment of a toggle TR mechanism assembly 100 for an electrical receptacle in various stages of operation is shown. As depicted, the assembly 100 is positioned below the face plate of an electrical receptacle (not shown). The assembly 100 generally comprises a housing 10 defining an open operational area in which the constituent parts are seated. Including a hot blade door 20, a neutral blade door 30, a toggle body 40, a spring 50, and a plunger housing 60.

The top of the housing walls include a first pair 11A, 11B and second pair 12A, 12B of round openings for receiving respective outwardly extending circular hinge pin heads 21A, 21B and 31A, 31B of the hot blade door 20 and neutral blade door 30. The housing walls also includes oppositely disposed central track grooves 13A, 13B sized and positioned to serve as guide tracks for posts 43A, 43B to hold the central platform 40 in a manner that allows it to stay centrally disposed in the housing 10 while also allowing the platform to both pivot (or "toggle") and descend and ascend evenly and vertically as discussed in more detail herein. As will also be discussed in more detail herein, the housing 10 defines a generally trapezoidal bottom cup portion 15 for accommodating the operational features of the toggle mechanism.

The hot blade shutter door 20 and the neutral blade shutter door 30 are positioned in the housing 10 such that their pivot points are 21, 31 are away from each other and the doors 20, 30 pivot inwardly and down. With this configuration, as the tines of a plug enter the openings in the device's faceplate, the plug blades hit the shutter doors 20, 30 and the downward force attempts to pivot them downwardly and centrally. The positioning of the doors 20, 30 and the direction of their pivoting play a central role in the tamper resistant protection of the device.

Figure 2:
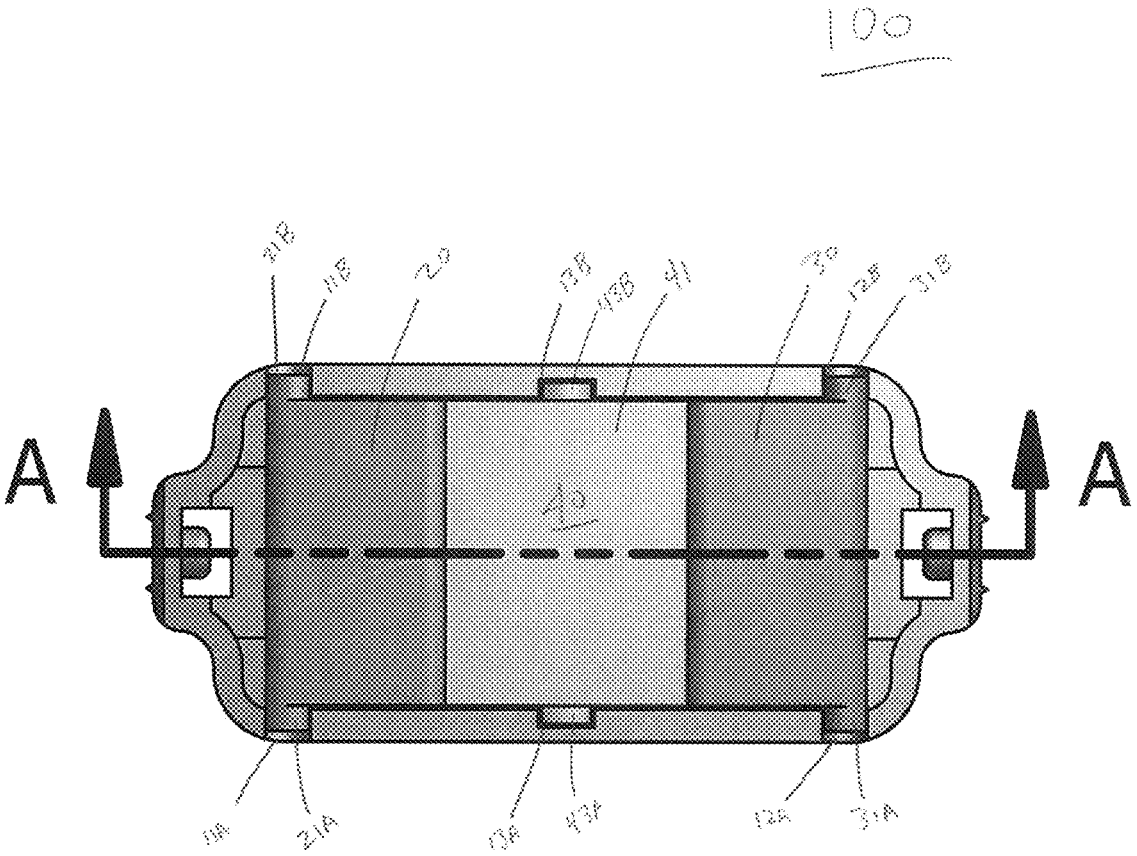
FIG. 2 is a top view of the toggle TR assembly of FIG. 1 with the shutters in the "closed" position.
Figure 3:
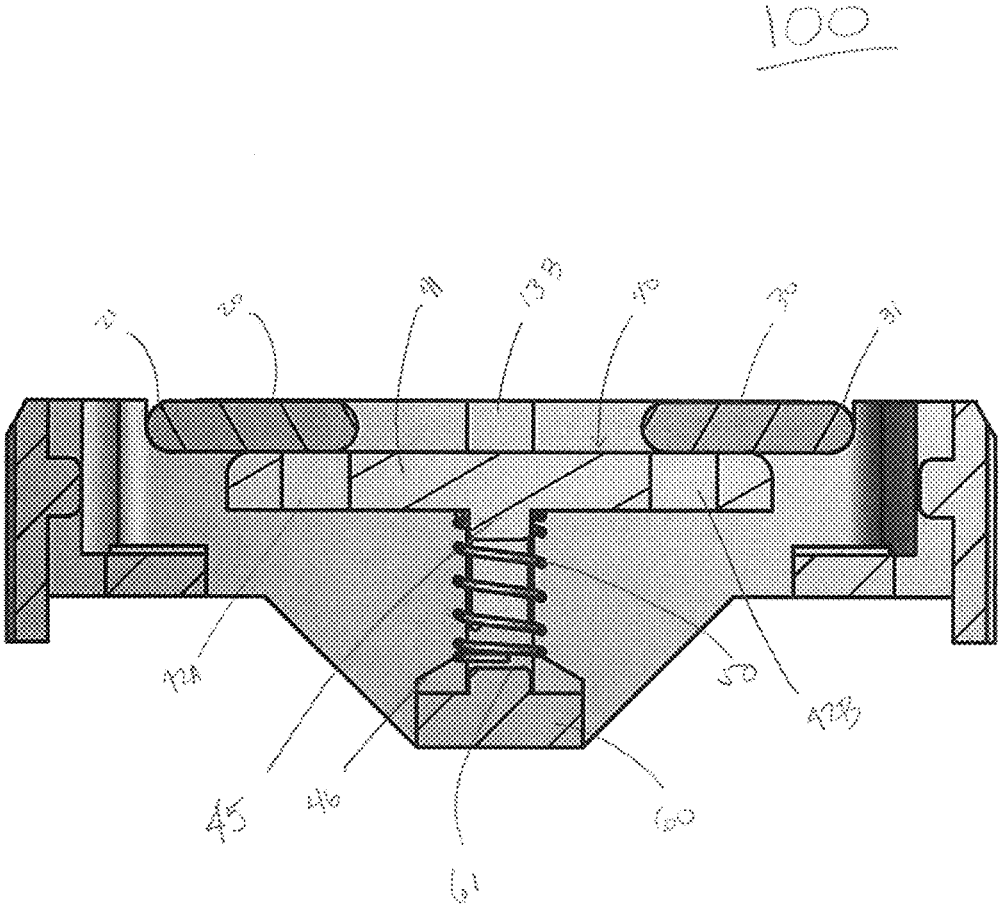
FIG. 3 is a cross-sectional side view taken along line A-A of FIG. 2 of the toggle TR assembly in the "closed" position.

To elaborate, turning to FIGS. 2 and 3, seated below the doors 20, 30 is a toggle body 40. The toggle body 40 comprises a platform portion 41 having plug blade openings 42 and a central post 45 descending downwardly from the underside of the platform 41. The platform 41 of the toggle body 40 is sized to expand the distance between the doors 20, 30 such that the blade openings 42 in the platform 41 are blocked by the doors 20, 30 when in the "closed" position.

The "closed" position is achieved by spring biasing the platform 41 upwardly to hold the pivot doors 20, 30 horizontally in the housing 10. To this end, in the embodiment depicted, the central post or plunger 45 is surrounded by a helical spring 50 that biases the toggle body 40 upwardly against the doors 20, 30. As depicted, the spring 50 is seated on its distal end along the periphery of a bore 61 in a plunger housing 60. To accommodate the plunger housing 60, the housing 10 of the assembly 100 includes the trapezoidal cup portion 15 discussed earlier.

A user desiring plug an electrical device into the receptacle to start the flow of electricity by reaching the receptacle's electrical contacts must get the assembly 100 into the "open" position. The "open" position is the state wherein the doors 20, 30 pivot a distance sufficient to reveal the blade openings 42. When the blade openings 42 are accessible, a plug being inserted into the device will pass through the openings and "plug in" to the device's electrical contacts. Reaching the "open" position may only be realized by applying force, and more particularly, near equal force, to both plug blade openings at the same time. As will be appreciated, this essentially requires that both blades of a plug be inserted into the device at the same time. In order to illustrate how the toggle assembly provides the tamper resistance required for the receptacle, a comparison of what happens when a single blade opening is invaded, versus when both blade openings are invaded.

Figure 4:
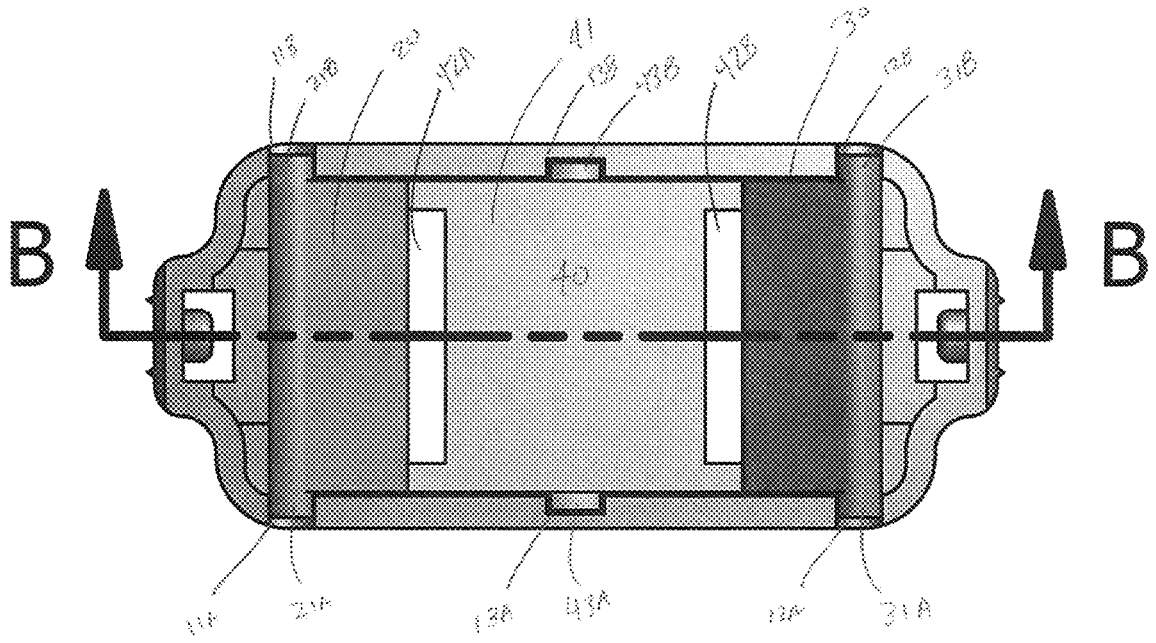
FIG. 4 is a top view of a toggle TR assembly in the open position wherein both shutter doors have been pivoted to uncover the blade opening in the platform.
Figure 5:
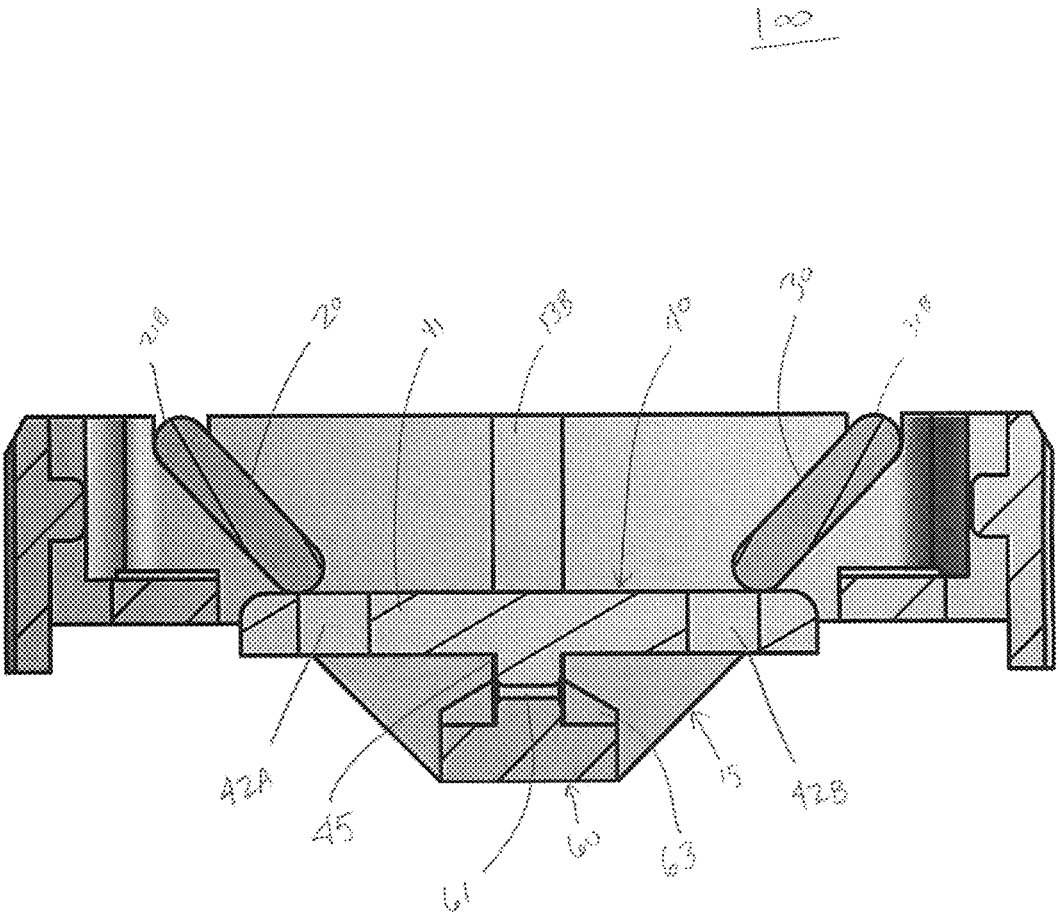
FIG. 5 is a cross-sectional view taken along line B-B of FIG. 4 of the toggle TR assembly in the "open" position.

Turning to FIGS. 4 and 5, the "open" position is depicted. As shown, to expose the blade openings 42A, 42B, the doors 20, 30 must be rotated downwardly and allowed to sweep far enough to clear the openings 42A, 42B. The only way to sweep far enough is for the toggle platform 41 to descend as the doors rotate. This is achieved by blades of a plug pressing downwardly on the doors 20, 30 causing them to press against the platform 41. When sufficient force is applied to overcome the bias of the spring 50 surrounding the central plunger 45, the normally outwardly biased plunger 45 is forced into the bore 61 of the plunger housing 60. The bore 61 provides a pathway for the post 43 to descend, which carries the platform deep enough to provide clearance for the doors 20, 30 to sweep downwardly enough to expose the blade openings 42A, 42B. The guide tracks 13 defined by the sidewall of the housing 10 receive outwardly extending posts 43A, 43B and thereby ensure that the toggle body 40 descends straight down so the plunger 45 remains on target for insertion in the bore 61 of the plunger housing 60. Once the platform descends enough that the blade openings 42A, 42B are exposed, the blades that pushed the doors 20, 30 downwardly pass into the openings 42A, 42B and reach the electrical contacts of the receptacle. At this point the electrical receptacle is operational.

When a user removes the electrical plug, the blades egress from the contacts and openings and the spring bias of spring 50 pushes the toggle body 40 upwardly which in turn pivots the doors 20, 30 closed. The device stays in the "closed" position until properly actuated by the simultaneous insertion of the blades of an electrical plug as discussed above.

Figure 6:
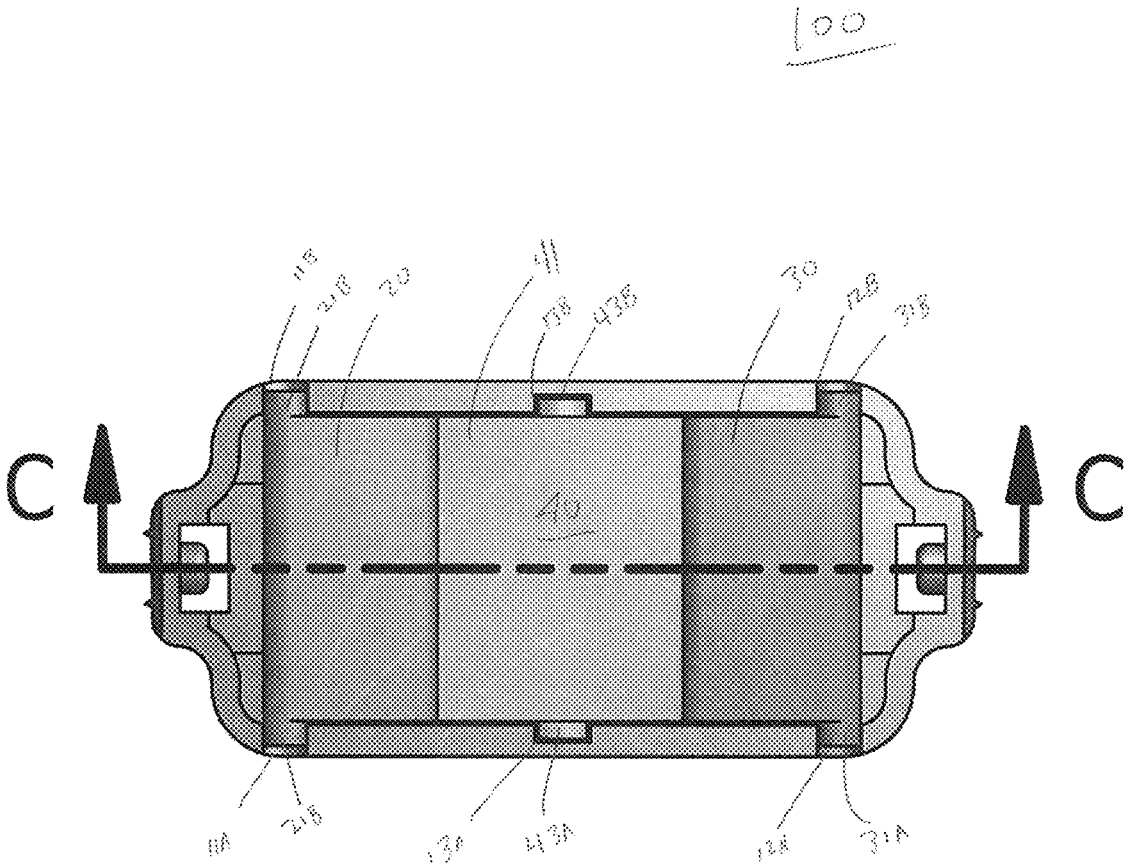
FIG. 6 is a top view of a toggle TR assembly in the "blocking" position wherein only one shutter door has been pivoted by insertion of an item into a single plug blade opening.
Figure 7:
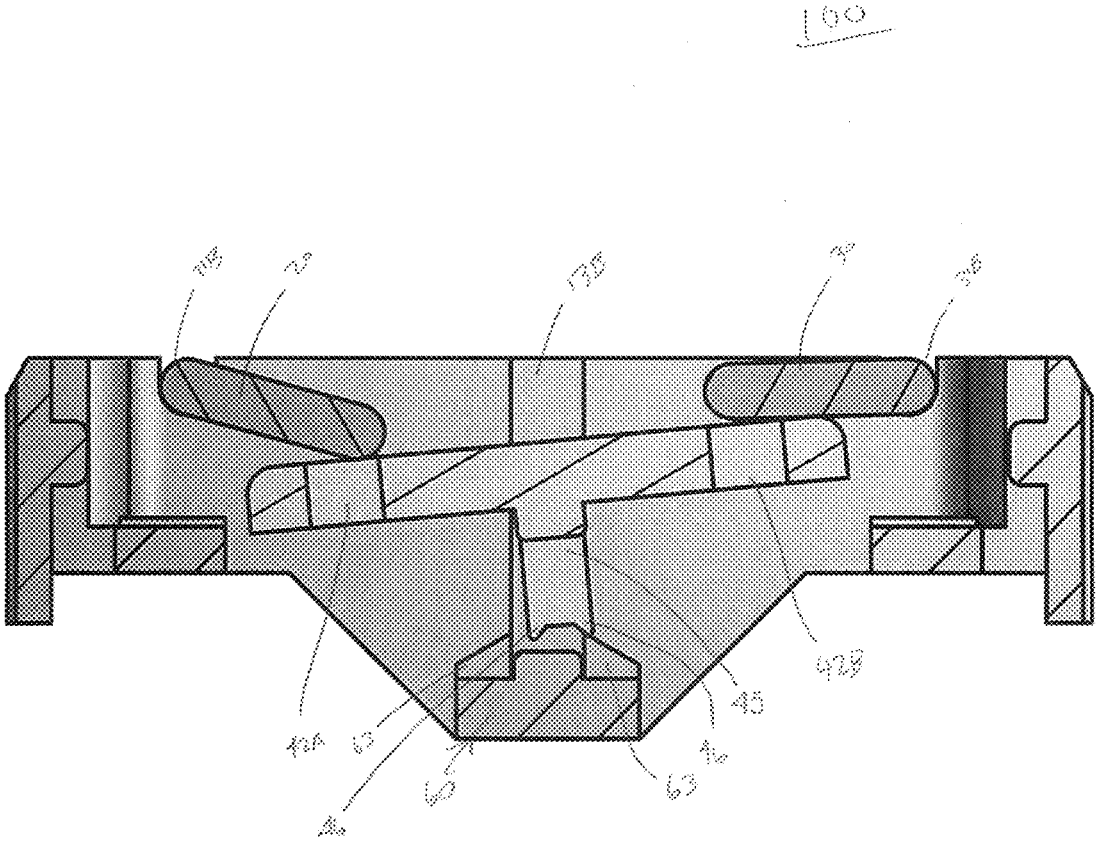
FIG. 7 is a cross-sectional view taken along line C-C of FIG. 6 of the toggle TR assembly in the "blocking" position.

To prevent insertion of an article into a single one of the blade openings from reaching the electrical contact that lies beneath, the toggling of toggle body 40 comes into play. As best shown in FIGS. 6 and 7, if a single blade opening, such as the hot opening, of the device is invaded, then only the hot shutter door 20 would begin to pivot. The hot shutter door 20 applies force to the platform 41 of the toggle body 40. The unevenness of the force being applied to only one side of the platform 41 causes the toggle body 40 to tip downwardly to that one side. The tipping is controlled by the interaction of the guide posts 43, tracks 13, and the other door 30 in combination with the configuration of the plunger housing 60. As shown, in this embodiment, as the toggle body 40 tips, its movement is limited by the opposite door 30 preventing any further rotation and the force attempts to move the platform downwardly. The now off-centered central plunger 45 moves downwardly out of line with the central opening 61 of the plunger housing 60. Teeth 46 disposed on the bottom of the plunger 45 engage a step 63 on the periphery of the bore 61. The plunger 45 is now mechanically blocked from entering the bore 61. Thus, the shutter door 20 cannot descend any further and will not be able to sweep past the blade opening 42A. The article inserted into the hot blade opening is prevented from reaching the electrical contact. The same toggling of the toggle body 40 prevents an article inserted into the neutral blade opening of the outlet from reaching the neutral contact of the device. It is only when both blades, and thus shutter doors, are engaged that the toggle body 40 will be properly positioned to descend far enough for the doors 20, 30 to rotate and clear the blade openings 42A, 42B of the platform 41.

The frictional advantages of the present embodiment (and related embodiments) will be appreciated by one of ordinary skill in the art armed with the present specification. By allowing the shutter doors to cooperate to overcome the bias of a single spring member, the force of both plug blades may be used to cooperatively compress the spring and thus result in a lessoning of the impact to the shutter doors from repeated blade insertions, thereby potentially prolonging the life of the product. Similarly, the downward motion and cooperating guides and tracks provide for smooth movement of the toggle body may provide additional life expectancy to devices since downward motion does not have to be translated into lateral movement (which implicates frictional forces of sliding members).

One of ordinary skill will appreciate that the exact dimensions and materials are not critical to the invention and all suitable variations should be deemed to be within the scope of the invention if deemed suitable for carrying out the purposes of the invention.

Likewise, one of ordinary skill in the art will readily appreciate that it is well within the ability of the ordinarily skilled artisan to modify one or more of the constituent parts for carrying out the various embodiments of the invention. Once armed with the present specification, routine experimentation is all that is needed to decide the parameters, physical configuration, and constituent parts that may be used or adjusted for carrying out the present invention.

The above embodiments are for illustrative purposes and are not intended to limit the scope of the invention or the adaptation of the features described herein to particular TR receptacles. Those skilled in the art will also appreciate that various adaptations and modifications of the above-described preferred embodiments can be configured without departing from the scope and spirit of the invention. Therefore, it is to be understood that, within the scope of the appended claims, the invention may be practiced other than as specifically described.

What is claimed is:

1. A tamper resistant receptacle comprising:

a receptacle housing comprising a front face defining at least one plug receiving area comprising a hot blade opening and a neutral blade opening for receiving a respective hot and neutral blade of an electrical plug;

a pair of shutter doors rotatably disposed beneath a respective one of said hot and neutral blade openings;

a toggle mechanism disposed beneath said shutter doors, wherein each shutter door must engage the toggle mechanism to move the toggle mechanism in a downward generally vertical direction to allow the shutters doors to rotate downward a distance sufficient to place the device into the open position.

2. The tamper resistant receptacle of claim 1, wherein said toggle mechanism comprises a platform spring biased to hold said shutter doors in a closed position.

3. The tamper resistant receptacle of claim 2, wherein simultaneous insertion of a hot and neutral plug blade into the hot and neutral blade openings with sufficient force to overcome the spring bias of said platform causes the descent of the platform which allows the shutter doors to continue their downward rotation a distance sufficient to uncover said hot blade and said neutral blade openings and allow said plug blades blade to pass through the openings and contact electrical contacts in said housing.

4. The tamper resistant receptacle of claim 2, wherein each shutter door rotates to influence the orientation of a toggle platform and only when insertion of force into both the hot and neutral openings of the device at the same time do the shutter doors pivot to contact the toggle platform with force sufficient to overcome the spring bias and allow the platform to descend downwardly.

5. The tamper resistant receptacle of claim 4, wherein insertion force into only one of the device's plug-blades openings causes the platform to tip and blocks the platform from descending far enough for the doors to rotate into a position that exposes the plug blade openings in the platform, thereby blocking access to the devices electrical contacts.

6. The tamper resistant receptacle of claim 5, wherein the toggle platform includes a neck or plunger portion that is spring biased in a closed position and as the shutter doors contact the platform and overcome the spring bias, the neck portion is positioned to descend into an neck-receiving shaft of a plunger housing, wherein the neck and platform descend until the blades of the plug pass through the platforms openings.

7. The tamper resistant receptacle of claim 6, wherein a helical spring is deployed around the neck plunger and biased against a top step area of a plunger receptacle housing and a bottom of the platform, whereby if only one of the rotating doors contacts the platform, the platform tips in the direction of the door such that the bottom of the platform neck catches on a step on the plunger housing, thereby offsetting the path of the plunger sufficient enough to block its descent into the shaft of the plunger housing.

* * * * *